United States Patent [19]

Mueller et al.

[11] Patent Number: 4,600,966

[45] Date of Patent: Jul. 15, 1986

[54] IGNITION CONTROL SYSTEM

[75] Inventors: George R. Mueller, Union Grove; Thomas W. Huitema, Racine, both of Wis.

[73] Assignee: J. I. Case Company, Racine, Wis.

[21] Appl. No.: 617,952

[22] Filed: Jun. 6, 1984

[51] Int. Cl.[4] ..... H01H 47/22

[52] U.S. Cl. ..... 361/166; 307/10 R

[58] Field of Search ..... 361/166, 193, 194; 70/239, 252; 307/10 R, 10 LS; 123/179 B, 179 BG

[56] References Cited

U.S. PATENT DOCUMENTS

| | | | |
|---|---|---|---|
| 3,376,467 | 4/1968 | Ree | 361/194 |
| 3,963,940 | 6/1976 | Adamian | 307/10 LS |
| 4,314,307 | 2/1982 | Sivahop et al. | 361/194 |
| 4,350,901 | 9/1982 | Kogawa et al. | 307/10 R |

OTHER PUBLICATIONS

*Standard Handbook for Mechanical Engineers,* Seventh Edition, Theodore Baumeister, editor, pp. 15-110 to 15-114; 1967.

*Primary Examiner*—L. T. Hix
*Assistant Examiner*—David M. Gray
*Attorney, Agent, or Firm*—Dressler, Goldsmith, Shore, Sutker & Milnamow, Ltd.

[57] ABSTRACT

An ignition control system for the internal combustion engine of a material handling implement is disclosed for selectively actuating each of a plurality of control switches, wherein one of the said switches controls an associated electrical device. An ignition switch having a plurality of selectable positions arranged in a predetermined sequence directs a master control signal to the control switches. The master control signal is directed to the control switch associated with the electrical control device only upon completion of movement of the ignition switch through the predetermined sequence of positions. Once the predetermined sequence has been effected, the master control signal is continuously directed to the control device for providing actuation thereof, until the ignition switch is moved to an off position.

2 Claims, 1 Drawing Figure

IGNITION CONTROL SYSTEM

TECHNICAL FIELD

The present invention relates to an ignition control system for an internal combustion engine, and more particularly to an improved ignition control system for selectively energizing each of a plurality of electrical control switches in conjunction with effecting engine ignition.

BACKGROUND OF THE INVENTION

There are many installations where ignition control systems are used to selectively control ignition of an internal combustion engine and to selectively provide power to electrical loads associated with the engine-driven implement. Typical ignition control systems provide actuation of a starter motor to crank the engine for ignition, and direct power to the electrical device associated with the implement through the use of a key switch. However, this type of ignition control system does not prevent power from being directed to the associated electrical device prior to cranking of the engine. Such a system can be disadvantageous when it is desired to "jump start" the implement engine (i.e., without cranking the starter motor) since the associated electrical devices may inadvertantly be energized.

In view of the shortcomings of the ignition systems previously known, it is desirable to provide an ignition control system facilitating independent selective energization of an engine's starter motor and the associated devices of the engine-driven implement so that the devices are operable only after the engine is cranked for starting. This helps relieve the burden on the electrical system during starting of the engine and allows a majority of the electrical power to be utilized for the starting function. Further, it is desirable to isolate the associated electrical devices such that the devices will not be energized during jump-starting of the engine on which the system is installed. It is also desirable to provide an ignition switch system which is simple in construction for economical manufacture and reliability, efficient in operation, compatible with currently used engines and easily installed.

SUMMARY OF THE INVENTION

The ignition control system embodying the present invention has been particularly configured for achieving the above goals. When the present system is incorporated in a material-handling implement having an internal combustion engine and an associated electrical system, the present system functions to selectively operate electrical control switches used to direct power to an associated electrical device. This is accomplished by directing a master control signal to selectively actuate the control switches in a predetermined sequence, with one of the switches controlling the associated electrical device.

The ignition control system of the present invention includes an ignition switch having a plurality of selectable positions arranged in a predetermined sequence for directing the master control signal to the control switches. In addition, the system includes means for directing the master control signal to the one control switch associated with the electrical device only upon completion of movement of the ignition switch through the predetermined sequence of selectable positions. Thus, the associated electrical device is operable only after the ignition switch has moved through its predetermined sequence.

In the illustrated embodiment, the ignition switch comprises a key switch movable through the predetermined sequence of positions, including an initial "off" position. Upon movement through the predetermined sequence of positions, the one control switch and the associated electrical device remain actuated and powered through maintaining circuitry until the ignition switch is again moved to the "off" position.

The ignition control system of the present invention is particularly suited for use on material handling equipment where it is desirable to prevent actuation of one or more selected electrical devices of the implement prior to cranking the engine for starting, and during jump-starting operations. Significant convenience and efficient operation can thus be realized.

Numerous other advantages and features of the present invention will become readily apparent from the following detailed description of the invention and embodiment thereof, from the appended claims, and from the accompanying drawings in which like numerals are employed to designate like parts throughout the same.

DESCRIPTION OF THE PREFERRED EMBODIMENT

Figure 1:
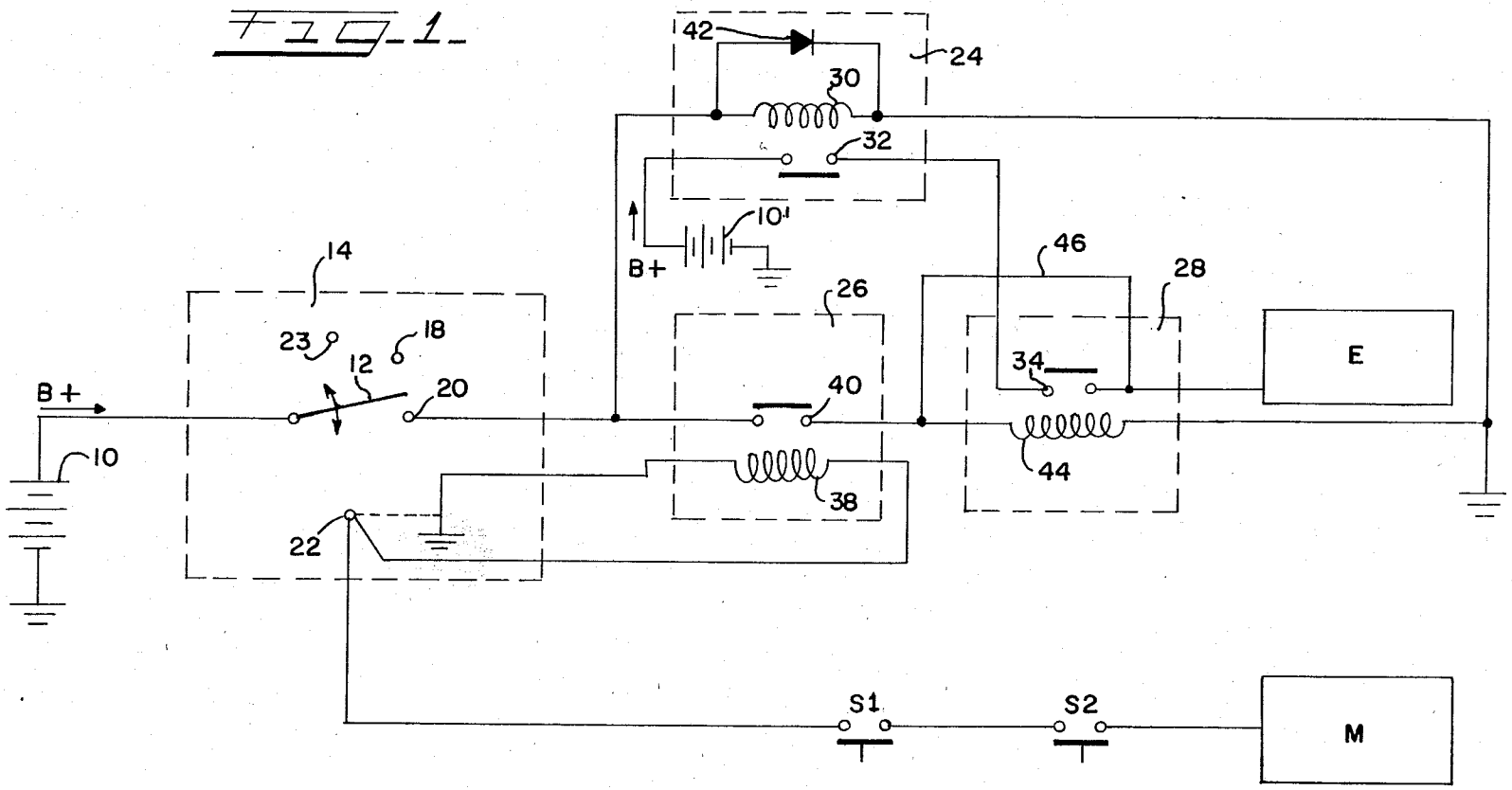
FIG. 1 is a detailed electrical schematic diagram showing the ignition control system embodying the principles of the present invention.

While the present invention is susceptible of embodiment in many different forms, there is shown in the drawing and will herein be described in detail a presently preferred embodiment of the invention. It should be understood, however, that the present disclosure is to be considered as an exemplification of the principles of the invention and is not intended to limit the invention to the embodiment illustrated.

FIG. 1 illustrates a detailed electrical schematic diagram showing connection of the present ignition control system for effecting operation of an internal combustion engine, and for effecting operation of one or more electrical devices associated with a material handling implement driven by the engine. A D.C. voltage source 10, usually comprising a battery of six, twelve or twenty-four volts, produces a master control signal B+ which is applied to a movable contact or wiper 12 of a key-operated ignition switch 14.

The master control signal B+ may be selectively directed to any one of a plurality of contacts attendant to positioning of the ignition switch 14 to selectively actuate each of a plurality of electrical control switches. One of the control switches controls an electrical device E associated with the material handling implement. While the present ignition control system is illustrated as controlling only one associated electrical device, it should be understood that the system is readily adaptable to control a plurality of such electrical devices, including but not limited to a trailer hitch, a transmission, or the like.

Ignition switch 14 includes a plurality of selectable positions arranged in a predetermined sequence for directing master control signal B+ to the control switches. As can be seen from the drawing, the predetermined sequence of positions includes a first "off" position 18 in which the operator of the material handling machine may insert and withdraw an ignition key that allows the switch to be positioned. From the first "off" position 18, the user may select a second "on" position 20 and thereafter a third "cranking" position 22, thereby having effected the predetermined sequence of selectable positions. In addition, an "accessory" position 23 is also provided and is selectable through movement of ignition switch 14 in an opposite direction from the "off" position 18.

The ignition control system also includes means for directing the master control signal B+ to the control switch associated with the electrical device E only upon completion of movement of the ignition switch through the predetermined sequence of selectable positions. Configuration of the ignition control system in this manner avoids unintended operation of the electrical device E prior to cranking of the engine for starting.

As can be seen from the drawing, the control switches are illustrated as electrical relays each having an energizable coil and a set of contacts controlled in response to the state of the coil. The present ignition control system includes a load relay 24, an interlock relay 26, and a control relay 28 to which the master control signal B+ is selectively directed through positioning of ignition switch 14.

While the illustrated relays comprise normally open relays, it will be appreciated by those skilled in the art that circuit modifications can be made to the ignition control system to accommodate use of other types of relays and like circuit components including, but not limited to, normally closed relays. It will further be appreciated that while the control switches are illustrated as relays, various other switch configurations may be adapted for use in the present ignition control system and still perform the same switching function. Such configurations may include, but are not limited to, analog, digital and combination analog-digital circuit configurations.

To obtain the desired selective actuation of the control device E associated with the electrical system of the material handling implement, the master control signal B+ supplied to wiper 12 of ignition switch 14 is connected to each of the switch positions contacts in the predetermined sequence described above. Upon movement of ignition switch 14 from the "off" position 18 to the "on" position 20, the master control signal B+ is directed to a load relay coil 30 of load relay 24 energizing the coil and closing load control relay contacts 32. From the drawing it will be seen that the master control signal B+ is also provided to one side of the load control relay contacts 32. While a separate power source 10' is illustrated as providing the master control signal B+ to control relay contacts 32, it will be appreciated that in actual circuit design this source may be the same source used to supply the master control signal B+ to wiper 12.

When the load control relay contacts 32 are closed the master control signal B+ is then provided to one side of control relay contacts 34 of the control relay 28. Since the control relay contacts 34 are in an open condition, the master control signal B+ is not passed across the contacts to activate electrical control device E.

With the movement of the ignition switch 14 from the "off" position 18 to the "on" position 20, interlock relay coil 38 of interlock relay 26 remains in an unactuated state. Therefore, normally open interlock relay contacts 40 of the relay 26 remain open. In order to complete the circuit path across interlock relay contacts 40, ignition switch 14 must be moved through "on" position 20 and into the "cranking" position 22, completing the predetermined positioning sequence and thereby energizing interlock relay coil 38. Energization of interlock relay coil 38 is provided only in the "cranking" position of ignition switch 14.

As can be seen with reference to ignition switch 14, the master control signal B+ will be directed through wiper 12 of the switch through interlock relay coil 38 and back to ground, completing the current path. The ground connection is made through the ignition switch case which is connected to the frame of the implement on which the ignition control system is used.

It will be understood by those skilled in the art that the larger the difference in potential between any two points in a circuit, the greater the flow of current through that portion of the circuit, assuming that there is no variation in resistance. Therefore, in order to obtain the largest flow of current through interlock relay coil 38, the ground connection is made to the frame of the material handling device on which the ignition control system is mounted. It will be further understood that although the ground connection is illustrated as being made through the ignition switch case, the case being connected to the frame of the material handling device, it is possible to make such a connection to ground in a variety of ways, such as by a separate wire connection to the frame of the material handling device bypassing the ignition switch case.

In the illustrated embodiment of the present invention, wiper 12 of ignition switch 14 is configured such that when the switch is moved from the "on" position 20 to the "cranking" position 22, a spring mechanism associated with the wiper biases the wiper back to the "on" position and out of the "cranking" position upon release of the switch key. Therefore, in order for the ignition switch 14 to be moved into the "cranking" position, the operator of the system must apply the necessary force to bias the spring mechanism.

When ignition switch 14 is moved from the "on" position 20 to the "cranking" position 22, both the "on" position contact and the "cranking" position contact are connected to wiper 12 simultaneously. This allows interlock relay contacts 40 to close, thereby directing the master control signal B+ to control relay coil 44 of control relay 28, thus closing control relay contacts 34 and thereby directing the master control signal B+ to electrical device E.

In addition, the master control signal B+ is directed to cranking motor M through a pair of neutral start switches S1 and S2. The switches S1 and S2 are typically associated with the transmission of the material handling device such that the circuit path to cranking motor M is completed only when the transmission of the device is in a neutral condition and its associated clutch disengaged. If this condition exists, cranking motor M is engaged upon movement of ignition switch wiper into the "cranking" position 22. Since both the "on" and "cranking" contacts 20 and 22 are connected with the master control signal B+ through ignition switch 14 simultaneously, load relay coil 30 is energized when the ignition switch wiper 12 is moved into the "on" position, and remains energized when the wiper is moved into the "cranking" position and returned to the "on" position. Accordingly, load relay contacts 32 do not open when ignition switch 14 is moved into the "cranking" position.

The ignition control system of the present invention further includes means for maintaining control relay contacts 34 closed only after completion of movement of wiper 12 through the predetermined sequence of positions, i.e., from the "off" position 18 into the "on" position 20 and then into the "cranking" position 22, with the wiper 12 returning to the "on" position after release from the "cranking" position. Further, control relay 28 is actuated and control relay contacts 34 are maintained in the closed position only while wiper 12 of ignition switch 14 is in the "on" position 20 or "cranking" position 22. When the switch wiper 12 is moved to the "off" position 18, control relay contacts 34 open and cannot be closed again until wiper 12 traverses the predetermined position sequence outlined above.

In the illustrated embodiment of the present ignition control system, the provision for maintaining control relay contacts 34 closed is provided through connecting the side of control relay contacts 34 associated with the electical device E between one side of the control relay coil 44 and one side of interlock relay contacts 40 through latch circuit wire 46. This latch circuit wire connection 46 maintains the control relay contacts 34 closed after ignition switch 14 is returned from the "cranking" position 22 to the "on" position 20. Control relay contacts 34 are maintained closed since the latch circuit wire 46 provides a path from the source 10 to ground while energizing control relay coil 44. The master control signal B+ is directed through load relay contacts 32, through control relay coil 44 and through control relay contacts 34. A diode 42 is included across load relay coil 30 to help direct the flow of the master control signal B+ through coil 30, due to the interconnection of latch circuit wire 46 as described above.

Self maintenance of control relay 28 in this respect is provided in the present circuit to maintain the connection of the master control signal B+ with electrical control device E after the ignition switch wiper 12 is returned to the "on" position 20 after cranking of motor M. This is required since energization of the interlock relay coil 38 occurs only during positioning of the switch wiper 12 in the "cranking" position 22. Therefore, when the ignition switch wiper 12 is returned to the "on" position 20 after being in the "cranking" position 22, interlock relay coil 38 is no longer energized, opening interlock relay contacts 40, thereby severing the connection directing the master control signal B+ through the ignition switch wiper 12 and through the interlock relay contacts 40.

In order to provide the master control signal B+ to the electrical control device E after the ignition switch is returned to the "on" position 20, it is necessary to provide an alternate circuit path. This alternate circuit path is provided by the latch circuit wire 46 which is connected as described above and operable to facilitate directing the master control signal B+ to electrical device E. Latch circuit wire 46 provides a circuit path which allows energization of control relay coil 44 independently of the closing interlock relay contact 40. The latch circuit wire 46 completes the electrical signal path from the source 10, directing the master control signal B+ through closed load relay contacts 32 and closed control relay contacts 34 to electrical device E. This alternate circuit path is maintained as long as the ignition switch wiper 12 is in the "on" or the "cranking" positions 20 or 22 after the ignition switch wiper 12 has moved through the predetermined sequence necessary to close the interlock relay contacts 40. When wiper 12 is moved into the "off" position, all circuit paths are opened since all of the relay coils are de-energized.

It will be appreciated by those skilled in the art that while the latch circuit portion 46 is shown as a wire interconnection of two points in the present ignition control circuit, a variety of latch circuits may be employed to provide an alternate current path for energizing control relay coil 44. Such alternate current paths include, but are not limitd to, analog, digital, combination analog-digital circuitry and the like. It will further be appreciated that the present invention is shown in the preferred embodiment utilizing existing ignition system components readily found on currently used material handling equipment. Accordingly, various circuit modifications may be made and additional circuit components added to the presently disclosed ignition control system, as covered by the claims, while still providing the advantages disclosed herein.

In summary, the master control signal B+ is directed along a predetermined signal path for actuation of the necessary relays, i.e., load relay 24, interlock relay 26 and control relay 28. This predetermined signal path is only available after the ignition switch wiper has been moved through a predetermined position sequence from the "off" position 18 to the "on" position 20 and into the "cranking" position 22. Upon movement of ignition switch wiper 12 into the "cranking" position 22 the predetermined signal path necessary to provide a master control signal B+ to electrical control device E is established. This predetermined signal path is maintained upon return of the ignition switch wiper 13 to the "on" position and until the ignition switch wiper 12 is moved to the "off" position 18.

Thus, a unique cost effective ignition control system is provided which is adapted for use with material handling equipment, while utilizing the existing components of the ignition systems thereon. The ignition control system of the present invention desirably provides isolation of an electrical control device associated with the electrical system of a material handling implement or the like, thereby preventing inadvertant operation of the electrical control device until a predetermined sequence of connections is established.

From the foregoing, it will be observed that numerous variations and modifications may be effected without departing from the true spirit and scope of the novel concept of the present invention. It is to be understood that no limitation with respect to the specific embodiment illustrated herein is intended or should be inferred. It is, of course, intended to cover by the appended claims all such modifications as fall within the scope of the claims.

What is claimed is:

1. An ignition control system for a material handling implement comprising:

a plurality of operatively connected control switches, including a first load control switch, a second interlock control switch, and a third control switch which controls an associated electrical device;

ignition switch means having a plurality of selectable positions arranged in a predetermined sequence for directing a master control signal to said control switches, said ignition switch means including a first off position, a second on position wherein said master control signal is directed only to said first load control switch, and a third cranking position wherein said master control signal is further directed to said second interlock control switch whereby energization thereof directs said master control signal to said third control switch for operation of said associated electrical device, said selectable positions being arranged in a predetermined sequence terminating in said cranking position;

means operatively connecting said third cranking position of said ignition switch means with an associated starter motor, including neutral indicator switch means for preventing cranking of the starter motor unless a transmission of said implement is in a neutral condition; and means for directing said master control signal for actuating said associated electrical device only upon completion of movement of said ignition switch means through said predetermined sequence, including means for maintaining actuation of said third control switch until said ignition switch means is moved to said off position, said maintaining means comprising latch circuit means operatively associated with said third control switch to allow energization of said third control switch independently of closing of said second interlock control switch to maintain actuation of said third control switch until movement of said ignition switch means to said off position.

2. The ignition control system of claim 1 wherein each of said control switches comprises a relay.

* * * * *